United States Patent [19]

Boldt, Jr.

[11] Patent Number: 4,845,470

[45] Date of Patent: Jul. 4, 1989

[54] TAMPER EVIDENT CLOSURE APPARATUS

[76] Inventor: Norton K. Boldt, Jr., 24272 Sunnybrook Cir., El Toro, Calif. 92630

[21] Appl. No.: 64,118

[22] Filed: Jun. 18, 1987

[51] Int. Cl.[4] ..... G08B 21/00

[52] U.S. Cl. ..... 340/540; 215/201; 604/404; 340/309.15; 340/508; 340/572; 340/693

[58] Field of Search ..... 340/540, 693, 568, 571, 340/572, 309.15; 215/201; 116/72, 67 R, 85, 100; 604/404; 368/10

[56] References Cited

U.S. PATENT DOCUMENTS 2,019,393 10/1935 Carah ..... 340/568

4,711,368 12/1987 Simons ..... 215/201 X

*Primary Examiner*—Glen R. Swann, III

*Attorney, Agent, or Firm*—Jackson & Jones

[57] ABSTRACT

A tamper evident closure apparatus is described in which a closure sensing switch is positioned inside of a container for nonprescription drugs and the like for producing a lid removal signal upon the removal of the lid from the container. A sound signal generator responds to the lid removal signal and generates an auditory sound of safety signal informing the person opening the container that the lid has not been previously removed. A safety circuit also responds to the removal of the lid and inhibits the sound signal generator from responding to a second or subsequent lid removal signal so that the replacement and subsequent removal of the lid will not trigger the generation of a second sound of safety signal.

21 Claims, 6 Drawing Sheets

TAMPER EVIDENT CLOSURE APPARATUS

BACKGROUND OF THE INVENTION

1. Field of the Invention

This invention relates to an apparatus for providing an indication that a container for personal consumption products such as nonprescription drugs has or has not been previously opened and possibly tampered with.

2. Background of the Invention

There have been a number of instances where psychologically disturbed persons have intentionally contaminated nonprescription medical products as well as food products with poisons or other hazardous substances which have caused injury or death to persons consuming or using the products. For example, cyanide has been inserted into capsules containing the pain killer Tylanol®. As a result, the drug industry has commenced using containers with one or more plastic seals so that a breaking of the seals will be evident to the consumer. However, such seals are simple mechanical devices and can generally be replaced without requiring complicated equipment. It has also been suggested that a sensor material, in a gaseous or solid state be incorporated into a sealed container in an artificial atmosphere and arranged to change color when the container is opened. Such systems require special packaging techniques and require the presence of light and the visual attention of the person opening the container to be effective.

There is a need for an effective and easy to assemble tamper evident closure apparatus.

SUMMARY OF THE INVENTION

In accordance with the present invention, a tamper evident closure apparatus is provided for informing the consuming public that a closure lid has or has not been removed (and replaced) from a drug, food container or the like after initial installation. The closure apparatus includes closure sensory means disposed within the container, e.g. attached to the inside of the closure lid, and responsive to the removal of the lid from the container for providing a lid removal signal. A signal generator responsive to the lid removal signal generates a predetermined signal (e.g. an auditory safety signal) in forcing the person opening the container that the lid has not been previously removed. Safety means, responsive to the removal of the lid on the first opening, inhibits the signal generator means from responding to a second or subsequent lid removal signal so that the replacement and subsequent removal of the lid will not trigger the generation of a second safety signal. Thus the presence of the safety signal upon removing the lid from the container informs the consumer that the container has not been previously opened or tampered with.

The organization and operation of the invention may best be understood by reference to the following description taken in conjunction with the accompanying drawings in which the same elements are identified by the same reference numerals.

DESCRIPTION OF THE PREFERRED EMBODIMENT

Figure 1:
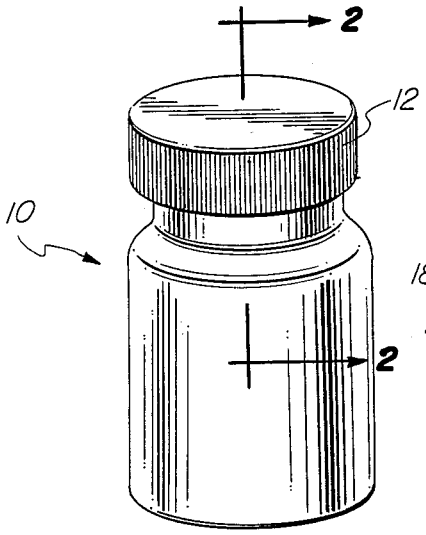
FIG. 1 is a perspective view of a container for nonprescription drugs and the like having mounted therein a tamper evident closure apparatus in accordance with the invention.
Figure 2:
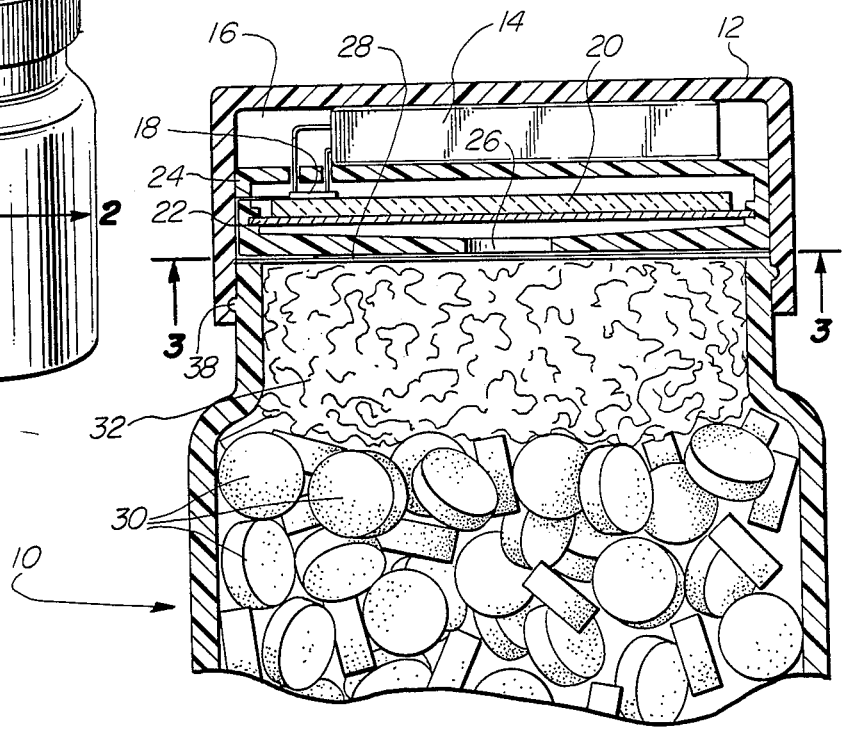
FIG. 2 is a cross-sectional view of the container of FIG. 1 taken along lines 2—2.
Figure 3:
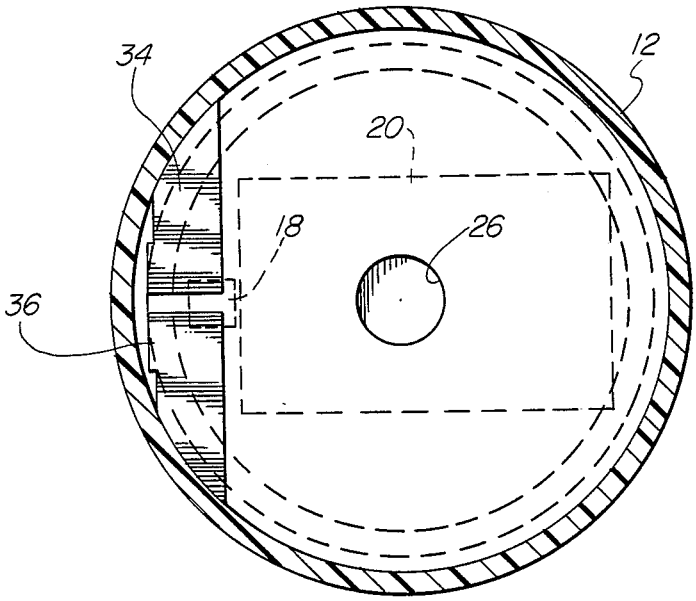
FIG. 3 is a plan view of the cap of the container taken along lines 3—3 of FIG. 2.

Referring now to the drawings and more particularly to FIGS. 1, 2 and 3, there is illustrated a container 10 for nonprescription drugs and the like. A lid 12 adapted to be screwed onto the container to close or open the mouth thereof, is equipped with the tamper evident closure apparatus of the present invention as is illustrated more particularly in FIG. 2. A battery 14 is carried in a top partition 16 of the lid 12 for supplying power to an integrated circuit chip 18 and a piezoelectric ceramic transducer or sound generator 20 mounted on a shelf 22 secured within a housing 24. The housing 24 is suitably fastened within the lid 12 (e.g. by an adhesive or solvent bonding) during the assembly process and defines a central opening 26 through which sound generated by the transducer 20 is projected when the lid is first removed from the container, as will be explained. An electrically conducting sheet 28, such as aluminum foil, is sealed across the mouth of the container as shown to hermetically seal the contents 30 of the contained as is well known in the art. Conventional packing material 32, such as cotton, extends below the seal 28.

A pair of contacts 34 and 36 is carried by the housing 24 for engaging the metal foil seal 28 when the lid is screwed onto the container 10 by threads 38 during the assembly process.

Figure 4:
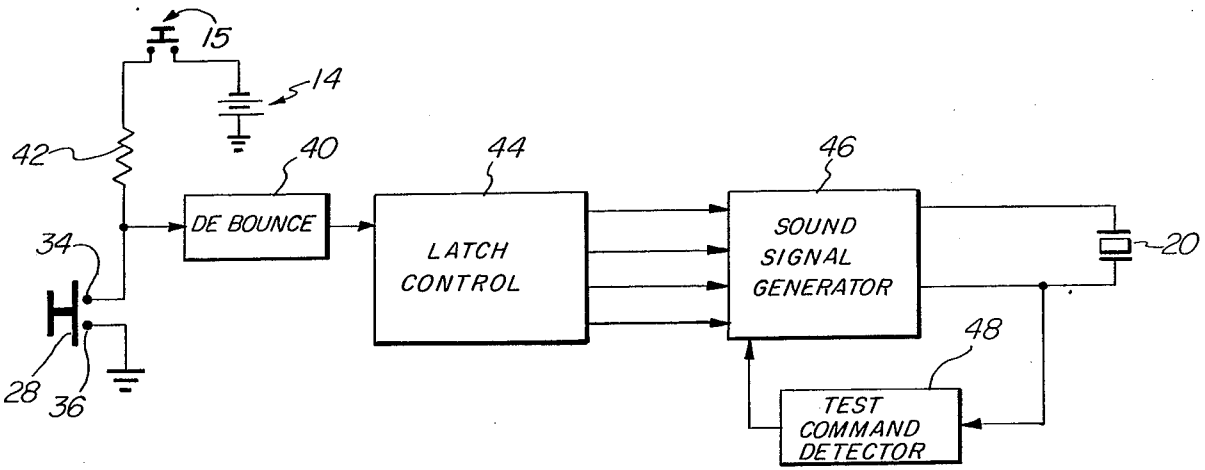
FIG. 4 is a block diagram of a tamper evident closure apparatus in accordance with the invention.

Referring now to FIG. 4, there is illustrated in block format an electronic circuit to be incorporated into the chip 18 for activating the sound generating transducer 20 (which may be in the form of a piezoelectric ceramic tranducer) to provide a distinctive sound (i.e., sound of safety) when the lid 12 is first removed from the container 10.

In general, the circuit of FIG. 4 senses the condition of the contact closure (i.e., contacts 34, 36 and foil 28) and activates the sound generator 20 when the lid is first removed. To provide an auditory signal (sound of safety) of sufficient loudness to attract the attention of the person opening the container. Upon reclosure, the circuit inhibits any further activation of the generator, thereby insuring the person opening the container that it has not been opened before or tampered with. The circuit may be tested for operability without removing the lid 12 or effecting its tamper evident function by the application of an external audio test command signal either before or after installation, as will be explained.

The contact closure or closure sensing means (contacts 34, 36 and foil 28) acts as a switch when the lid is installed at the assembly site pulling the input of a debounce circuit 40 from the positive level of the battery 14 to ground through a high impedance resistor 42. The battery 14 is permanently connected to the resistor 42 through a link 15 during assembly, as will be explained in connection with FIG. 5.

Upon opening the lid, the resistor pulls the debounce circuit's input to the positive battery potential (i.e., high or logic level one) and starts a debounce period or delay. The value of the resistor 42 is very high to limit the standby current and minimize current drain and prolong the shelf life of the apparatus. The delay provided by the debounce circuit must be sufficiently long to accommodate a slow or unsteady opening of the container and sufficiently short so that the lid cannot be removed and replaced after the contents have been adulterated. A delay of approximately a ½ second is normally expected to meet both requirements. After the built-in delay of about a ½ second, the debounce circuit 40 provides an output (high level) to a latch control circuit 44 which, in turn, enables a sound signal generator 46. The generator 46 applies a distinctive electrical oscillatory signal across the faces of the transducer 20 to cause the transducer to vibrate and produce the desired audio signal informing the person opening the container opener that the lid has not previously been removed.

The transducer 20 also functions as a microphone in response to an externally generated test signal when it is not producing audio signals and supplies its output to a test detector 48 which, in turn, causes the sound signal generator 40 to drive the transducer at selected frequencies to thereby inform an inspector that the apparatus has:

(1) not been initially installed (contact closure not made);

(2) not been activated (i.e., lid not previously removed); and (3) previously been activated by a removal and replacement of the lid.

The above functions will be described in more detail.

Figure 5:
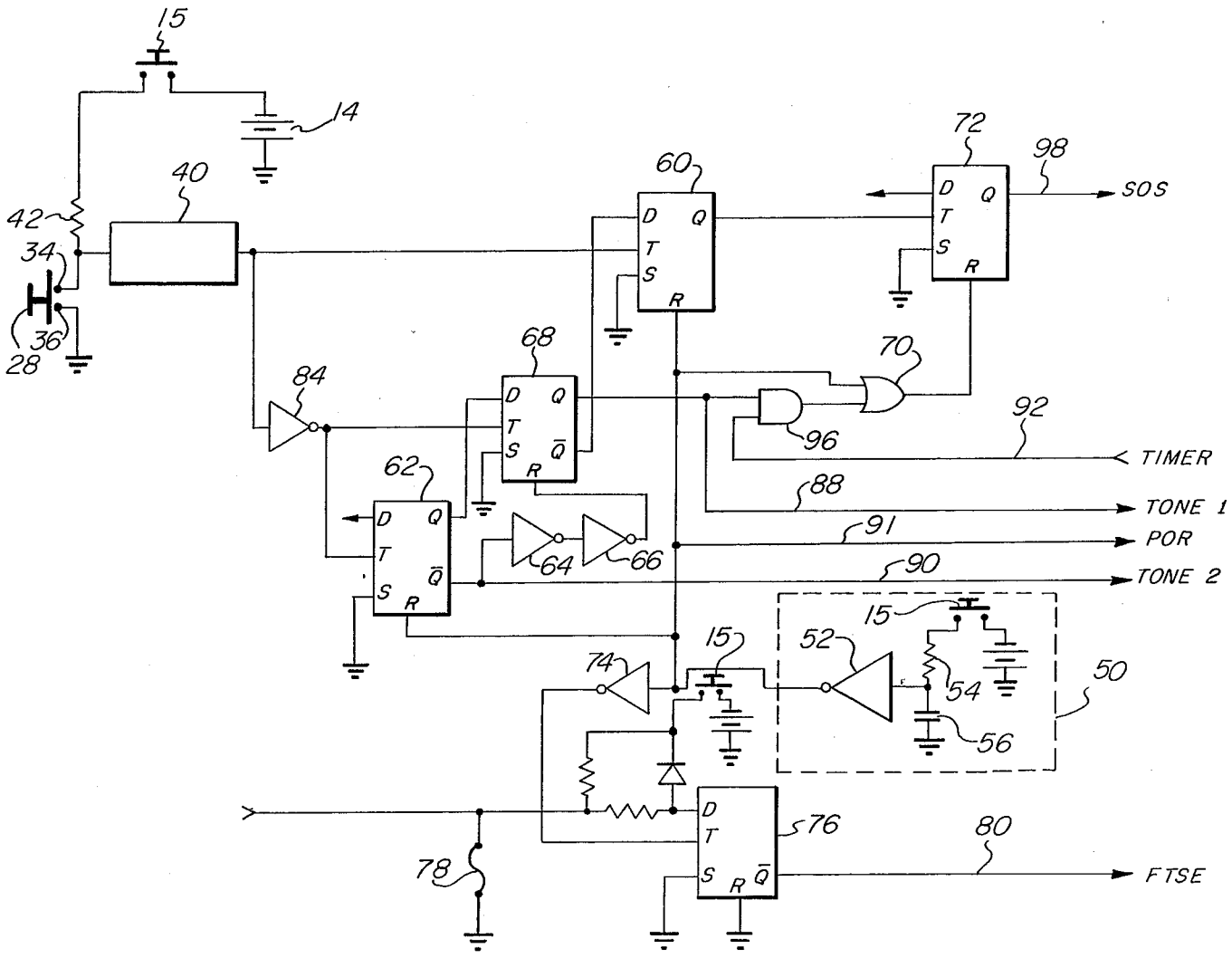
FIG. 5 is a block diagram of a latch control circuit for use in the apparatus of FIG. 4.

The latch control circuit 44 will now be described in connection with FIG. 5. This circuit includes a power-on reset generator 50 in the form of a Schmidt trigger inverter 52, the output of which is delayed by a time delay circuit comprised of resistor 54 and capacitor 56. This combination generates a system power-on reset ("POR") pulse when the connection is initially made from the circuit to the battery 14 by opening (blowing) the link 15 in the assembly operation.

Figure 6:
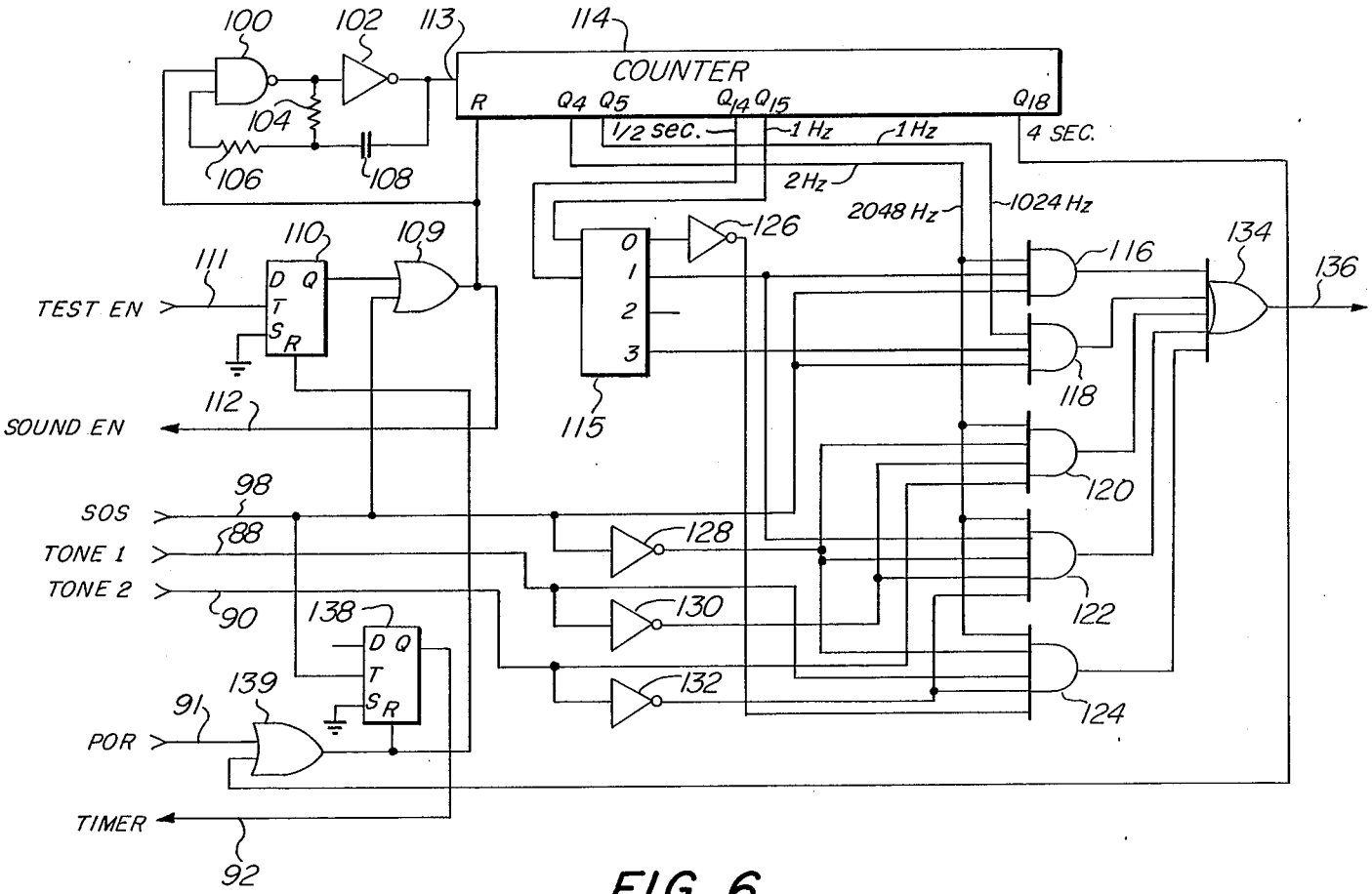
FIG. 6 is a block diagram of a sound signal generator for use in the apparatus of FIG. 4.
Figure 11:
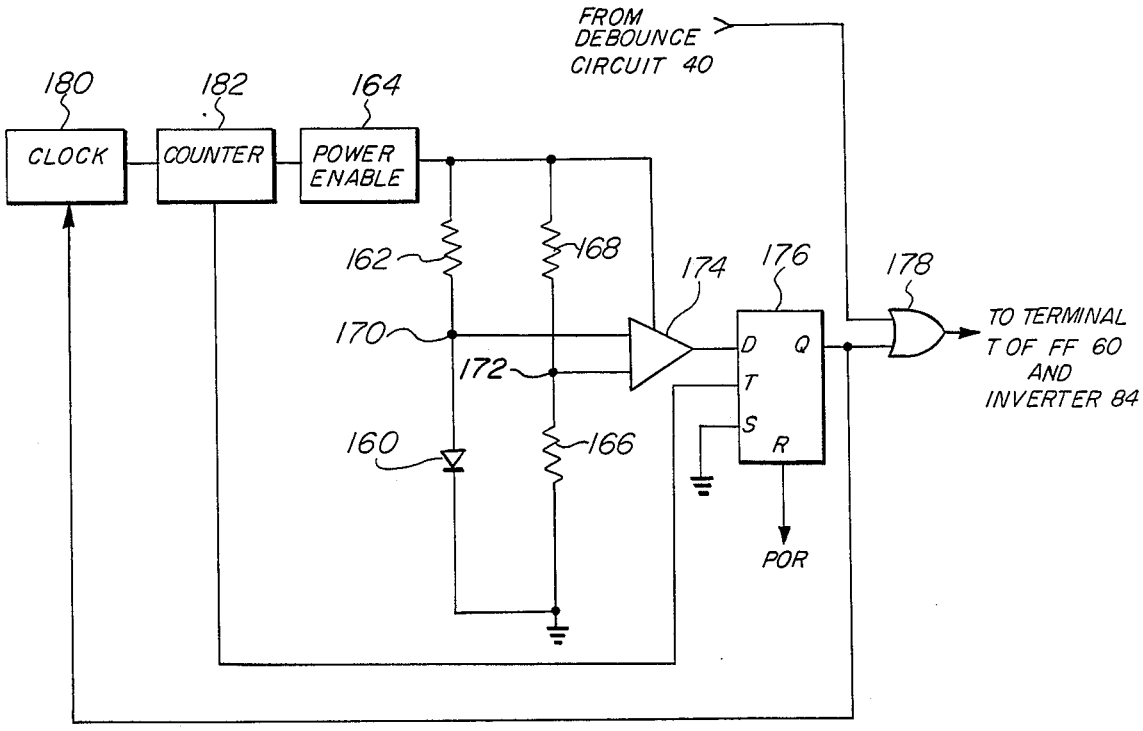
FIG. 11 is a block diagram of a temperature sensor circuit for inhibiting the sound signal generator when the temperature of the container content has exceeded or fallen below a preset level.

The POR pulse is applied to reset terminals (marked R) of flip flops ("FFs") 60 and 62 as shown. FF60 and FF62 are driven to the reset condition by the POR pulse. All flip flops in the circuit of FIGS. 5, 6 and 11 are positive edged triggered. The conventional input and output terminals of the flip flops i.e., R (reset), S (set), T (toggle or clock input), D (data input, output) Q (output) and $\overline{Q}$ (complementary Q output) are marked on FIGS. 5, 6 and 11.

The $\overline{Q}$ output of FF62 is set to logic 1 by the POR pulse and this output is applied via inverters 64 and 66 to the reset terminal R of a FF68 to hold FF68 in the reset condition. The Q output of FF62 is reset to logic 0, driving the D input of FF68 to logic 0.

The POR pulse is also employed through an OR gate 70 to reset a sound of safety ("SOS") enable FF72. The POR pulse inhibits sound generation during the power-on sequence.

The POR pulse is also inverted by an inverter 74 to provide a delayed clock pulse to the T input of a FF76. On initial power up, the D input of FF76 is at logic 0, held there by a fusible link 78. When the FF76 is clocked, the $\overline{Q}$ output thereof goes to logic 1, providing a "first time sound enable" (FTSE) signal on lead 80 to a audio driver circuit (FIG. 7) for the transducer 20 to be described.

An external command signal (e.g. at a higher voltage level than available with the battery 14) is applied to the positive battery lead after the battery is connected in the assembly operation to open the fusible link 78 (as by melting). Thus the fusible link becomes an open circuit after assembly. On any subsequent power-on cycle, the D input of FF76 is at logic 1, so that when clocked at the end of the POR pulse (applied to terminal T of FF76). the FTSE signal (on the Q terminal) is at logic 0, permanently inhibiting sound generation, as will be explained in more detail in connection with FIG. 7. This insures that a battery failure or removal and replacement at any subsequent time inhibits the generation of a sound of safety signal.

In the final step of the assembly process, the lid 12 with the tamper evident closure apparatus affixed thereto (and the battery connected) is installed on the container 10. After the debounce delay period (½ second), the logic output of element 40 goes to logic 0. This provides a negative going pulse to FF60, which does not modify the state of FF60. The negative going output pulse from the debounce circuit 40 also drives an inverter 84 to provide a positive going output pulse therefrom which clocks FF68 and FF62. The state of FF68 does not change because it is held in the reset code by the $\overline{Q}$ output of FF62. The $\overline{Q}$ output of FF62 goes to logic 0 and, after two inverter propagation delays from inverters 64 and 66, removes the reset condition from FF68. At this time, Q output of the FF62 goes to logic 1 driving the input of FF68 to logic 1.

It should be noted that the outputs Q and $\overline{Q}$ of FFs 68 and 62 are applied to leads 88 and 90. The POR pulse is also applied to lead 91. These leads are connected to the sound signal generator 46 to control the characteristics of the sounds generated by the transducer 20 depending upon the state of the latch control circuit (e.g. the sound of safety signal upon a first time lid removal or a specific test signal in response to an external test command signal), as will be explained. The Q output of FF68 is ANDed via an AND gate 96 with a signal on lead 92 from a timer in the sound signal generator 46. The output of the AND gate 96 is ORed with the POR pulse from the power on reset generator 50 and applied to the reset terminal R of FF72 via an AND gate 96. The Q output signal (SOS) of the sound of safety enable FF72 is also supplied to the sound signal generator via lead 98. The latch control circuit 44 is now ready for normal operation.

The sound signal generator 46 will now be described in reference to FIG. 6. In general, the sound signal generator 46 comprises a gated oscillator and a programmable waveform generator. Upon command from the sound of safety signal (SOS) (Q output of FF72) on lead 98, the sound signal generator applies a sound of safety signal to the transducer 20 causing the transducer to vibrate and produce an auditory signal informing the person opening the container that it has not been previously opened. The specific characteristics of the transmitted sound, i.e., duty cycle (envelop modulation) and frequency can be selected to fit the requirements of the manufacturer. The frequency and envelope modulations demonstrated here are intended as examples only.

The sound signal generator 46 upon actuation from the test command detector 48 and depending on the status of FF62 (indicating if the closure has been initially installed on the container) and the status of FF68 (indicating if the closure has been removed) produces a set of unique test indicator tones, as will be explained.

As is shown more particularly in FIG. 6, the gated oscillator of the sound signal generator consists of a NAND gate 100, inverter 102 and timing control components in the form of resistors 104 and 106 and capacitor 108. The SOS signal on lead 98 is ORed in an OR gate 109 with the Q output of a FF110. The clock input to the FF110 is a test enable 'signal on lead 111 from a test detector circuit to be described with reference to FIG. 7. When the output signal from the OR gate is at logic 0, the output of the NAND gate 100 is at logic 1 and the oscillator is inhibited. When the output signal from or gate 109 goes to logic 1 (indicating that the lid has been initially opened or that an external test command signal has been applied), NAND gate 100 functions as an inverter and the oscillation frequency is set by the timing components, for example, at a nominal frequency of 32.768 kHz. The output of the OR gate 109 (referred to as the sound enable signal) is also applied via lead 112 to a transducer driver circuit shown in FIG. 7.

The gated oscillator drives an input 113 of counter chain 114 which includes a reset terminal R and output terminals Q4, Q5, Q14, Q15 and Q18. The counter chain 114 may consist of a series of toggling flip flops with the Q outputs dividing successively by 2. With a nominal clock frequency of 32.768 kHz, the Q4 output is at 2048 Hz and the Q5 output is at 1024 Hz. Q14 provides a ½ second period square wave pulse and Q15 and Q18 provide 1 second and 4 second period pulses, respectively. The Q4 and Q5 signal outputs from the counter 114 drive a decoder 115 to provide four sequential tone signals at ½ second intervals. These sequential tone signals are gated with the SOS, TONE1, and TONE2 signals (on leads 98, 88 and 90) and with the continuous tone signals from counter outputs Q4 and Q5 via AND gates 116, 118, 120, 122 and 124, inverters, 126, 128, 130 and 132 and OR gate 134. The output of the OR gate 134 is applied to the transducer driver shown in FIG. 7 via lead 136.

The POR signal on lead 91 is ORed with the 4 second pulse from the Q18 output of the counter 114 and applied to the reset terminals of a FFs 138 and 110 to inhibit the operation of the gated oscillator (elements 100, 102, 104, 106 and 108) during the battery connection assembly step and to prevent the oscillator from stopping upon a reinstallation of the lid until a four second interval has elapsed. This latter action insures that a person opening the container will be made aware of the safety signal. The several possible output signals from the OR gate 134 are shown below in Table I:

TABLE I

| | Input State Logic Level |
|---|---|
| 1. Sound of Safety Signal | |
| SOS (signal on lead 98) | 1 |
| TONE1 (signal on lead 88) | 1 |
| TONE2 (signal on lead 90) | 1 |
| Output Signal From OR Gate 134: | |
| .5 Second No signal | |
| .5 Second 2048 Hz | |
| .5 Second No signal | |
| .5 Second 1024 Hz | |
| The cycle is repeated for a minimum of 4 seconds or until lid 12 is reinstalled. | |
| 2. First test signal, indicating that lid 12 not initially installed | |
| SOS | 0 |
| TONE1 | 0 |
| TONE2 | 1 |
| Test output signal from OR gate 134 is a 4 second 2048 Hz continuous tone | |
| 3. Second test signal, indicating that the tamper evident closure apparatus was not actuated (i e., seal unbroken) | |
| SOS | 0 |
| TONE1 | 0 |
| TONE2 | 0 |
| Test output signal from OR gate 134 is: | |
| .5 Second No signal | |
| .5 Second 2048 Hz | |
| 1 Second No signal | |
| The cycle is repeated four times to provide a 25% duty cycle envelope on 2048 Hz. | |
| 4. Third test signal, indicating that tamper evident closure apparatus was actuated (i.e., seal broken and lid 12 replaced) | |
| SOS | 0 |
| TONE1 | 1 |
| TONE2 | 0 |
| Test output signal from OR gate 134 is: | |
| .5 Second No signal | |
| 1.5 Second 2048 Hz. | |
| The cycle is repeated four times to provide a 75% duty cycle envelope on 2048 Hz. | |

Figure 8:
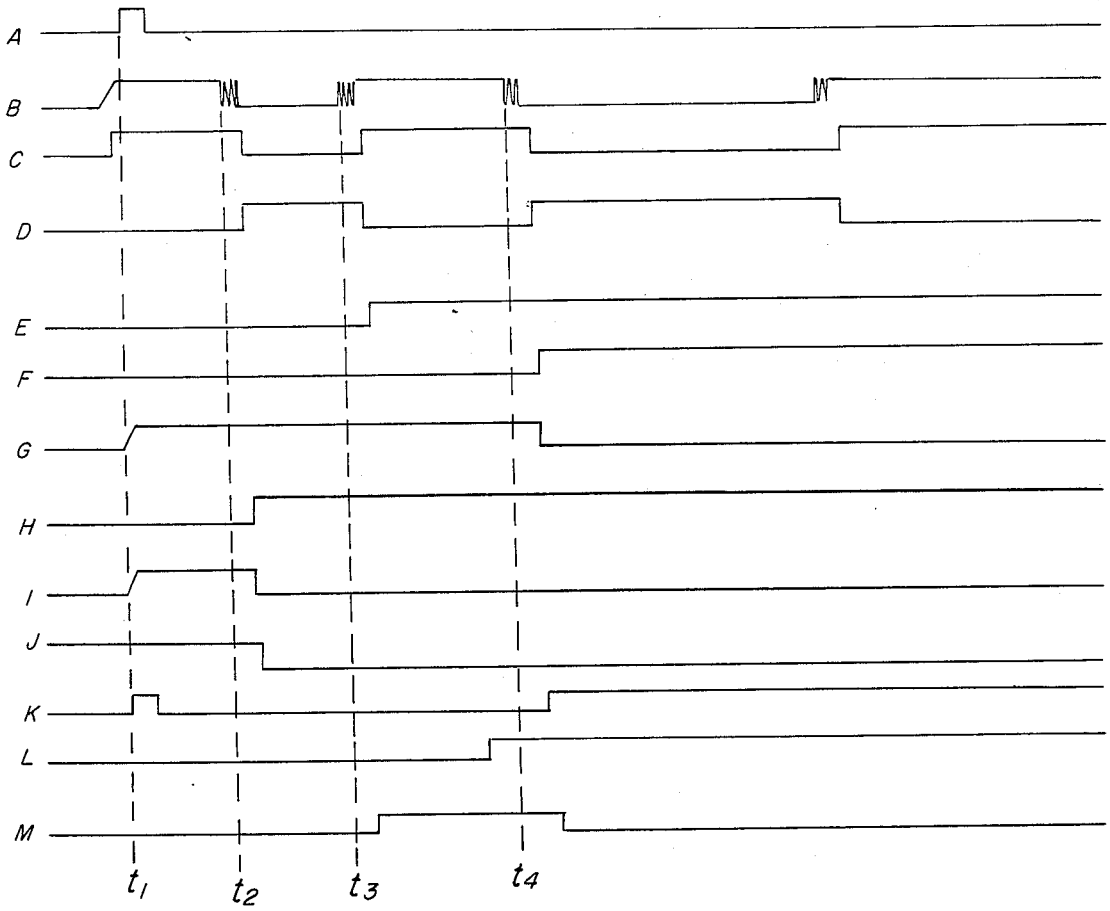
FIG. 8 is a timing diagram illustrating various waveforms present in the circuits of FIGS. 4–7.

The condition of the latch control circuit to provide the above logic levels on the SOS, TONE1 and TONE2 leads will be described in more detail in connection with the timing diagrams illustrated in FIGS. 8–10. The input state logic levels in the above table for activating the sound signal generator to produce the first, second and third test signal are sometimes hereinafter referred to as the first, second and third test sequence actuation signals, respectively.

Figure 7:
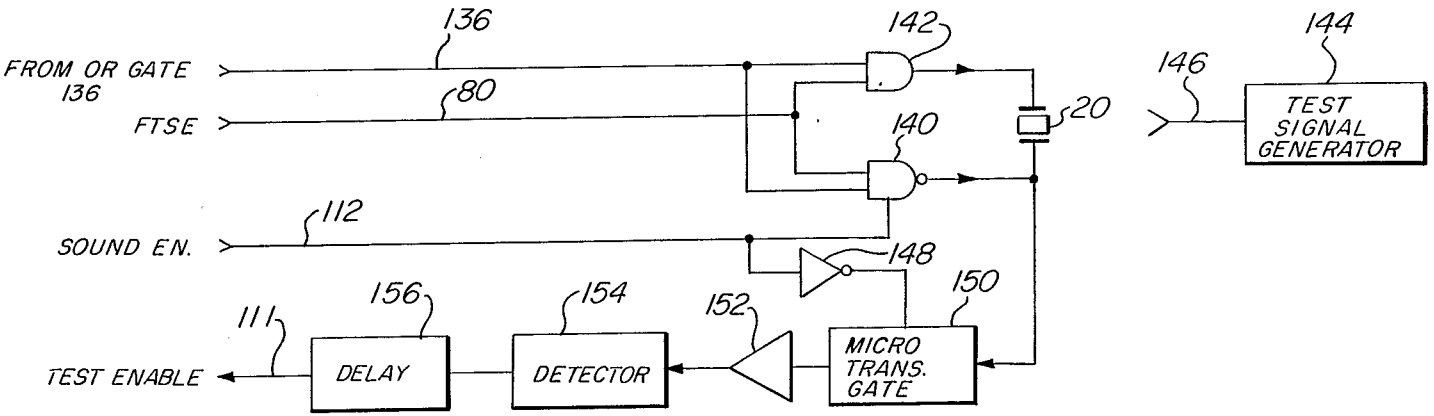
FIG. 7 is a block diagram of a transducer driver circuit and test detector for use in the apparatus of FIG. 4.

Referring now to FIG. 7, the output of the sound signal generator 46 is applied to a NAND gate/driver 140 and a non-inverting AND gate/driver 142, the outputs of which are applied across opposite faces of the ceramic transducer 20 as shown. When the sound enable signal on lead 112 is at logic 0, the output of the sound signal generator is at logic 0 and driver 140 is biased off. When the FTSE signal on lead 80 and the sound enable signal lead 112 are each at logic 1, the output of the sound generator on lead 136 (following one of the tone sequences of Table I) is applied to the piezoelectric ceramic transducer via the NAND and AND gate drivers 140 and 142. The output signals from the drivers 140 and 142 drive the transducer 20 differentially, applying a peak-to-peak signal to the element of twice the available battery voltage to produce a loud auditory sound of safety or test signal.

To verify that tamper evident closure apparatus is functioning properly, the piezoelectric element is used as an input device (microphone) and triggered with very strong audio signals from an external test signal generator 144 via antenna 146.

The test signal generator 144 generates a predetermined test signal in the form of a localized high power acoustic pulse train upon insertion of a container protected by the tamper evident closure device into a suitable fixture (not shown).

When the sound signal generator 46 is not driving the piezoelectric transducer 20 via signals on lead 136 (i.e., most of the time), one output of the sound generator circuit is connected logically to ground through AND gate driver 142. The active output of the transducer 20 is supplied to a microphone transmission gate 150. The NAND gate driver 140 output is an open circuit (e.g. high-impedance) unloading the transducer 20 at this time. The microphone transmission gate 150 is enabled by the sound enable signal (on lead 112) at logic level 0 (indicative that the sound signal generator is inhibited) through an inverter 148.

When the signal from the microphone is received, the output of a test signal amplifier 152 (connected to the output of the transmission gate 150) is driven to full logic levels. A detector, 154, functions as a debounce circuit to verify that the acoustic input has been maintained long enough to be a true signal, and not a vibration induced signal such as from a dropped container. The output of the detector 154 starts a delay timer 156. At the end of a preset delay (e.g. 2–4 seconds to allow the transmitted test signal from test signal generator 144 to be damped so that auditory signals from the transducer 20 can be detected), the delay timer 156 output transitions to logic level 1 and sets FF138 (FIG. 6) enabling the sound signal generator 46.

Test sound signal generation utilizes the same counter chain and logic as the sound of safety signal transmission. When the counter reaches the end of the nominal 4 second test signal period, counter Q18 goes to logic 1 and drives the reset input of FF138 through OR gate 139. This disables and resets the counter chain and all outputs (Q1 to Q18) go to the logic 0. This drives the reset input of FF11O back to logic 0, and the tamper evident closure apparatus is now ready to be tested again or to be actuated, i.e., closure removed.

The operation of the latch control circuit of FIG. 5 will now be described in more detail in reference to the timing diagrams and particularly to FIG. 8. The power-on reset (POR) pulse (waveform A of FIG. 8) is shown as occurring at time $t_1$. The closure of switch contacts 34, 36 with the metal foil 38 (waveform B) occurs at Time $t_2$. Curve B includes several transition cycles following time $t_1$ which represent brief transitions making and breaking of the contacts during the lid closure operation. The output of the debounce circuit 40 is shown at curve C. Curve D represents the complement of the debounce circuit output as applied to the clock inputs of FFs 62 and 68. Waveforms E and F illustrate the Q output pulses from the FFs 60 and 68, respectively, with the waveform F also representing the TONE1 signal on lead 88. Waveforms G, H and I represent the $\overline{Q}$, Q and $\overline{Q}$ outputs of FFs 68, 60 and 62, respectively, with the $\overline{Q}$ output of FF62 representing the TONE2 signal on lead 90. Waveforms J and K represent the reset pulses to FFs 68 and 72, respectively. Waveforms L and M represent the Q outputs from the FFs 38 (timer signal on lead 92) and 72 (SOS signal on lead 98), respectively.

Upon installation, the sound signal generator is inhibited by the POR signal and the delayed removal of the reset of FF68, as explained earlier. The tamper evident closure apparatus including the latch control circuit of FIG. 5 is now ready for operation.

When lid 12 is removed from the container 10 (i.e., time $t_2$), the switch contacts 34 and 36 are opened or disengaged from the conducting foil 28. After the ½ second debounce period, the output of the debounce circuit 40 (curve C) goes to logic 1. This output provides a positive edge clock to FF60 and drives inverter 84 which in turn provides a negative edge pulse to the clock inputs of FF68 and FF62. Since these FFs are positive edge triggered, their outputs are unaffected.

The positive edge signal from the debounce circuit 40 clocks FF60 and the logic 1 at the data input D of FF60 transfers to its Q output. The rising edge of FF60 Q output clocks FF72, transferring the logic 1 on the data input D of FF72 to the Q output. The rising edge of the Q output of FF72 starts the sound signal generator 46 in transmitting the "Sound of Safety" tone sequence and starts the 4 second timer, derived from the Q18 output of the counter chain 14.

When the lid is reinstalled and the closure contacts again made, the debounce circuit 40 output (after the ½ second delay) goes to logic 0. This negative going pulse does not affect FF60. However, the positive edge output from the inverter 84 clocks FF68. The logic 1 at the data input D of FF68 is transferred to the Q output of FF68, and the $\overline{Q}$ output of FF68 goes to logic 0, setting the data input D of FF60 to logic 0.

The Q output of FF68 drives one input of the AND gate 96 and the output pulse from the FF138 (FIG. 6) on lead 92 (timer signal) drives the other input of AND gate 96. If the output pulse on lead 92 has reached its count of 4 seconds, its output is at logic 1, and the positive edge signal from the Q output of FF68 generates a logic 1 at the output of AND gate 96, which is passed through OR gate 70 to the reset terminal R of FF72. This resets the Q output of FF72 to logic 0 and turns the sound signal generator off.

The status of FF68 Q output is indicative of the actuation of the sound of safety auditory signal and is passed to the test circuit and sound signal generator as signal TONE1 on lead 88. If the lid is replaced on the container in less than 4 seconds after initial removal, the output of AND gate 96 does not go to logic 1 until the timer signal on lead 92 goes to logic 1 at the end of its 4 second cycle. FF72 is thus not reset until the timer has completed its count (e.g. 4 seconds). This assures that the sound of safety is heard for a minimum of 4 seconds or one cycle of its programmed tone sequence, as discussed earlier.

On the first removal of the lid 12 and switch (34, 36) actuation after the initial lid removal, the debounce circuit's output "clock" to FF60 propagates the logic 0 on FF60 D input to its Q output. This drives the set (S) input of FF72 to logic 0. The outputs of FF72 remain unchanged and the sound signal generator 46 is not turned on. Therefore, the person removing the lid 12 will not hear the sound of the safety signal. When the lid 12 is replaced on the container 10 after the second or later) removal, the clock to FF68 (inverted by the inverter 84 with respect to the clock pulse to FF60, and normally stopping the sound of safety transmission) maintains the state of FF68's outputs. On the second (and any subsequent) removal of the lid 12, the debounce circuit's output clock to FF60 propagates the logic 0 on the FF60 input to the Q output. Since this output was already at logic 0, the outputs of FF60 and FF68 remain unchanged. The FF72 inputs remain unchanged and the sound signal generator 46 remains unactuated.

Figure 9:
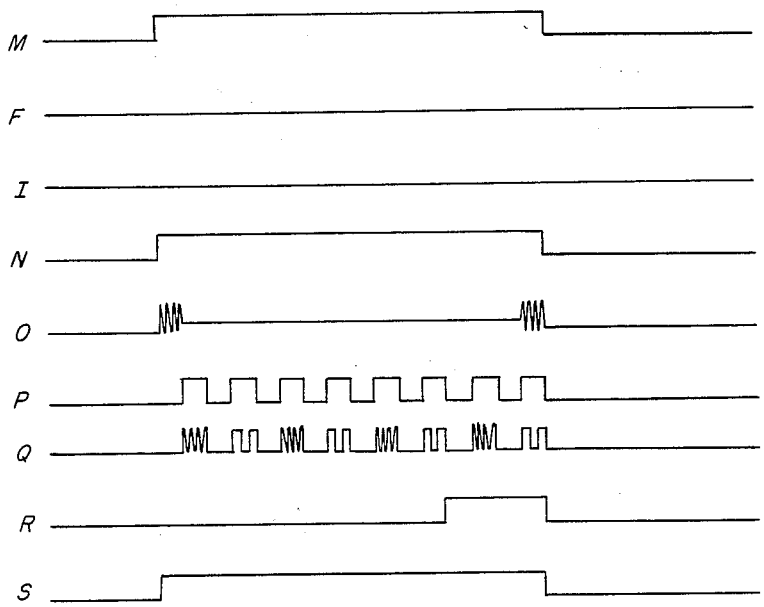
FIG. 9 is a timing diagram illustrating the input and output signal waveforms of the sound signal generator in response to the removal and reinstallation of the closure lid of the container.
Figure 10:
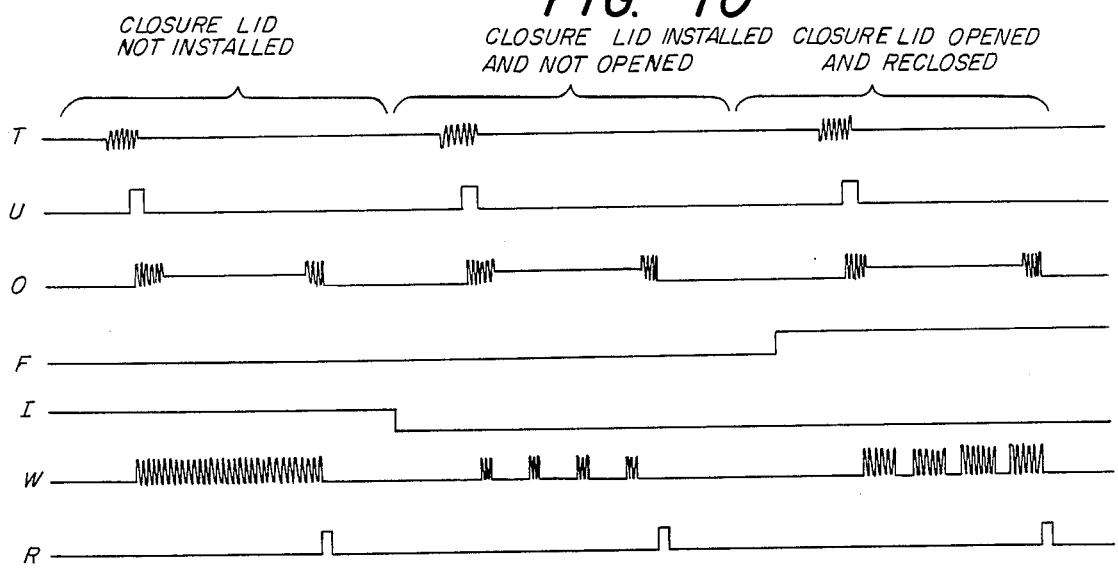
FIG. 10 is a timing diagram illustrating the input and output signal waveforms of the sound signal generator when the apparatus of FIG. 4 is being tested.

FIG. 9 contains waveforms illustrating the characteristics of the sound of safety signal. Curves M, F and I represent the waveforms of the SOS, TONE1 and TONE2 signals, as previously shown in FIG. 8. Waveform N represents the sound eanable signal on lead 112. Waveform O represents the signal at the input 113 of the counter 114. Waveform P represents the 1 Hz output (clock) from terminals 1 and 3 of the decoder 115. Waveform Q represents the composite sound of safety signal transmitted to the transducer driver circuit of FIG. 7, as described in Table I. Waveforms R and S represent the output signal from terminal Q18 of the counter 114 and the timer signal on lead 92 (from the Q output of FF138), respectively.

FIG. 9 illustrates the waveforms of the test signals as described in Table I for the three test conditions. Waveform T represents the external acoustic pulse train input to the transducer 20 from the test signal generator 144. Waveforms U represents the test enable signal on lead 111 and waveform W represents the composite output test signal from the crystal 20 for each of the conditions described in Table I as shown.

There has thus been described a tamper evident closure apparatus for informing the consumer that the container has not been opened previously and also for informing testing personnel of the history of the container without impairing the function of the apparatus. The apparatus is substantially fail safe in that if any element fails (e.g. the battery, chip, inter connections, etc.), the sound of safety signal cannot be generated.

The apparatus may also be used with a slight modification to inform a person opening the container, such as a pharmacist, that the container's contents have been exposed to undesirably high or low temperatures. To accomplish this purpose, a temperature responsive signal may be ORed with the debounce circuit's output as shown, for example, in FIG. 11. A temperature sensitive diode 160, the impedance of which changes with temperature, is connected in series with a resistor 162 between the output of a power enable circuit 164 and ground. A pair of reference resistors 166 and 168 are also connected in series between the power enable circuit and ground to form a well-known bridge circuit with the temperature sensitive diode. The junctions (170 and 172) of the series connected resistor/diode and resistor/resistor combinations are connected to two inputs of an analog voltage comparator 174 so that when battery voltage is supplied at the output of a power enable circuit 164 and the temperature of the diode 160 exceeds (or falls below) that required to provide a positive (or negative) output voltage across the junctions 170 and 172, the comparator 174 will produce a low level signal (logic 0) at its output. The output signal is in turn supplied to the data input D of a FF176 to produce a logic 0 signal at its Q output. The low level Q output is supplied via OR gate 178 to the terminal T of FF60 and to the inverter 84 to cause the latch control circuit to command the sound signal generator to produce the sound of safety signal. Any subsequent opening of the lid 12 will fail to produce the sound of safety signal informing the person opening the container that the contents should not be used.

To reduce the drain on the battery, the bridge network (elements 160, 162, 166 and 168) is energized only periodically. For this purpose, a clock generator 180 and counter 182 turn the power enable circuit 164 on (to supply battery voltage to the bridge) and trip the FF176 only periodically e.g. once every few hours.

Various modifications of the apparatus will be apparent to those skilled in the art without departing from the spirit and scope of my invention. For example, the tamper evident closure apparatus could be employed to insure that the contents of containers other than nonprescription drugs or food containers have not been tampered with (e.g. pouches for the delivery of confidential documents). The sound of safety signal can also take many forms including spoken words. If desired, a light signal such as the light emitted by a light emitting diode may be used in conjunction with or perhaps in place of the auditory safety signal to inform the person opening the container that it has not been previously opened. The closure sensing means may also take other forms. For example, a capacitance or inductance type switch may be used to provide a suitable input to debounce circuit 40.

It is not the intention to limit the invention to the particular embodiments disclosed. On the contrary, the invention is intended and shall cover all modifications, sizes and alternate constructions falling within the spirit and scope of the invention, as expressed in the appended claims when read in light of the description and drawings.

What is claimed is:

1. In a tamper evident closure apparatus for incorporation into a container for non-prescription drugs and the like for detecting whether a lid has been removed from the container after initial installation thereon, the combination which comprises:

(a) closure sensing means responsive to the removal of the lid from the container for providing a lid removal signal;

(b) sound generating means responsive to the lid removal signal for generating a safety signal informing the person opening the container that the container has not been opened previously; and (c) safety means responsive to the lid removal signal for inhibiting the sound generating means from responding to a second lid removal signal whereby the replacement and second removal of the lid will not trigger the generation of a second safety signal.

2. The invention of claim 1 further including a test signal generating means responsive to a removal of the lid and replacement and responsive to a predetermined test signal external to the container for triggering the sound generating means to produce a test signal indicating that the container has been opened previously.

3. The invention of claim 1 further including a test signal generating means responsive to the initial installation of the lid without a removal thereof and to a predetermined test signal external to the container for triggering the sound generating means to produce a test signal indicating that the container has not been opened.

4. The invention of claim 1 further including a test signal generating means responsive to the absence of the installation of the closure lid and to a predetermined test signal external to the container, for triggering the sound generating means to produce a test signal indicating that the closure lid has not been installed.

5. The invention of claim 1 wherein the closure sensing means includes delay means for delaying the generation of the lid removal signal a preset time after the removal of the lid from the container.

6. The invention of claim 5 wherein the closure sensing means includes a switching element which is opened upon removal of the lid.

7. The invention of claim 6 wherein the switching element comprises a pair of contacts carried by the lid and an electrically conducting sheet disposed over the opening in the container, the contacts engaging the electrically conducting sheet when the lid is secured over the opening in the container.

8. The invention of claim 1 further including temperature sensing means disposed within the container for producing an output signal representative of the temperature of the container's contents and comparator means for comparing the temperature sensing means output signal with a preset signal level and for generating an output when the temperature of the container's contents exceeds or falls below a pre determined temperature and wherein the safety means is responsive to the comparator means output for inhibiting the sound generating means from responding to a lid removal signal whereby a removal of the lid will not trigger the generation of the safety signal upon the occurrence of the comparator means output.

9. The invention of claim 1 wherein the sound generating means includes a transducer adapted to translate oscillatory electrical signals into sound waves and visa versa.

10. The invention of claim 9 wherein the transducer is a piezoelectric ceramic.

11. The invention of claim 1 further including a test signal generator external of the container for generating a predetermined acoustic test signal and test signal generating means disposed within the container and responsive to the external test signal and to the lid removal signal for generating first and second test sequence activating signals indicative that the lid has and has not be previously removed, respectively and wherein the sound generating means is arranged to generate first and second test signals in response to the first and second test sequence activating signals respectively for test signals.

12. A tamper evident closure apparatus for detecting whether a container has been opened after an initial closure thereof comprising:

(a) closure sensing means disposed within the container and responsive to the opening of the container for producing a container opening signal;

(b) signal generating means disposed within the container and responsive to the container opening signal for generating a safety signal informing the person opening the container that the container had not been previously opened; and (c) safety means disposed within the container and responsive to the container opening signal for inhibiting the signal generating means from responding to a second container opening signal whereby the closure and subsequent opening of the container will not trigger the generation of a second safety signal.

13. The invention of claim 12 wherein the signal generating means is arranged to generate a "sound of safety" audio signal.

14. The invention of claim 13 further including means responsive to a previous opening and closing of the container and to a predetermined auditory test signal external to the container for producing a test sequence activating signal and wherein the signal generating means is responsive to the test sequence activating signal for producing a test auditory signal indicating that the container has or has not been opened previously.

15. A tamper evident closure apparatus incorporated into a container for detecting whether a lid has been removed from the container after the initial installation comprising:

(a) a source of voltage;

(b) closure sensing means connected to the voltage source and responsive to the removal of the lid from the container for producing a lid removal signal in digital format;

(c) latch control means connected to the voltage source for generating a digital "sound of safety" signal in response to the lid removal signal;

(d) a sound signal generator connected to the voltage source generating a predetermined electrical oscillatory "sound of safety" output signal in response to the digital "sound of safety" signal;

(e) a transducer adapted to convert an electrical oscillatory signal into an audio signal;

(f) safety signal generating means responsive to the removal and replacement of the lid on the container for producing a "first time" sound enable signal only upon the initial installation of the lid; and (g) gating means coupled to the safety signal generating means and connected in series between the sound signal generator and the transducer for coupling the output signal from the sound signal generator to the transducer in response to the "first time" sound enable signal, whereby the transducer is driven to produce an auditory "sound of safety" signal only upon the first removal of the lid.

16. The invention of claim 15 including power on reset signal generating means for disabling the sound signal generator during the initial connection of the voltage source to the closure sensing means, latch control means and sound signal generator.

17. The invention of claim 15 wherein the transducer is piezoelectric ceramic.

18. The invention of claim 15 further including means responsive to a previous removal and reinstallation of the lid and to a predetermined test signal external to the container for producing a test sequence actuating signal and wherein the sound signal generator is responsive to the test sequence activating signal for producing a test auditory signal indicating that the container has been opened previously.

19. The invention of claim 15 further including means responsive to the installation of the lid without a removal thereof and to the predetermined external test signal for producing a test sequence actuating signal and wherein the sound signal generator is responsive to the test sequence activating signal for producing a test auditory signal indicating that the container has not been opened.

20. The invention of claim 19 further including means responsive to the absence of the installation of the closure lid and to the predetermined external test signal for producing a second test sequence actuating signal and wherein the sound signal generator is responsive to the second test sequence actuating signal for producing a second auditory test signal indicating that the closure lid has not been installed.

21. The invention of claim 15 wherein the closure sensing means includes a switching element which is actuated upon the removal of the lid.

* * * * *

UNITED STATES PATENT AND TRADEMARK OFFICE

CERTIFICATE OF CORRECTION

PATENT NO. : 4,845,470

DATED : July 4, 1989

INVENTOR(S) : Norton K. Boldt, Jr.

It is certified that error appears in the above-identified patent and that said Letters Patent is hereby corrected as shown below:

Column 5, line 21, "'signal" should read --signal--.

Column 5, line 24, after "OR gate" insert --109--.

Column 8, line 59, "or" should read --(or--.

Column 9, line 31, "inter connections" should read --interconnections--.

Column 11, line 17, "pre determined" should read --predetermined--.

Signed and Sealed this

Eighteenth Day of September, 1990

*Attest:*

HARRY F. MANBECK, JR.

*Attesting Officer*

*Commissioner of Patents and Trademarks*